US006559605B2

(12) United States Patent
Wu et al.

(10) Patent No.: US 6,559,605 B2
(45) Date of Patent: May 6, 2003

(54) SYNCHRONOUS MULTIPLE SERIAL-LAMPS SETS

(76) Inventors: Jeng-Shyong Wu, No.14, Alley 1, Lane326, Shin-Pin Rd, Shinchu (TW); Ming-Tang Lee, 5F, No.8, Alley 7, Lane328, Chung Shan Road Sec. 1, Yung Ho City, Taipei Hsien (TW)

( * ) Notice: Subject to any disclaimer, the term of this patent is extended or adjusted under 35 U.S.C. 154(b) by 0 days.

(21) Appl. No.: 09/764,266

(22) Filed: Jan. 19, 2001

(65) Prior Publication Data

US 2002/0097574 A1 Jul. 25, 2002

(51) Int. Cl.[7] ..... H05B 37/00

(52) U.S. Cl. ..... 315/185.5; 315/192; 362/252; 362/806

(58) Field of Search ..... 315/185.5, 192, 315/193, 185 R, 200 A; 362/806, 252, 227

(56) References Cited

U.S. PATENT DOCUMENTS 4,713,586 A * 12/1987 Chiang ..... 315/200 A
4,890,000 A * 12/1989 Chou ..... 307/36
5,854,541 A * 12/1998 Chou ..... 315/185 R
6,218,786 B1 * 4/2002 Chi ..... 315/185 S
6,382,814 B1 * 5/2002 Petrocelli ..... 362/252

* cited by examiner

*Primary Examiner*—Don Wong
*Assistant Examiner*—Ephrem Alemu
(74) *Attorney, Agent, or Firm*—Troxell Law Office PLLC

(57) ABSTRACT

A synchronous multiple serial-lamps sets includes a plurality of serial or serial and parallel lamp sets; an IC set, an IC set auxiliary part, a power supply connector; and a signal transmission line. The leads connect the lamp sets, IC set, IC set auxiliary part, power supply connector so as to be formed as an integral structure. The power supply connector is connected to a power supply for supplying power to IC set and IC set auxiliary part. In operation, multiple functions are generated, and the lamp sets are operated so that the light emitters are illuminated or extinguished. Any one IC set transmits a signal to each IC set, so as to start or reset each lamp sets and thus they have the same preset electric functions, and thus a function of synchronous operation in a plurality of lamp sets is achieved.

8 Claims, 5 Drawing Sheets

SYNCHRONOUS MULTIPLE SERIAL-LAMPS SETS

FIELD OF THE INVENTION

The present invention relates to a synchronous multiple serial-lamps sets comprise a plurality of serial or serial and parallel lamp sets: an IC set, an IC set auxiliary part, a power supply connector; and a signal transmission line. Each unit has a plurality of outputs which may push a plurality of series-lamp sets, and has many switching ways for controlling, so that the lamp sets have the same flashing effects in the transversal or longitudinal direction.

BACKGROUND OF THE INVENTION

The present invention relates to an improvement of flashing lamp sets, especially a novel lamp set structure, in which all lamps may flash at the same time and not overheat due to overloading.

The flash lamp sets are usually used as a decoration in celebrations, business advertisement and other special fields. In general, the lamp set cannot be overheated and more importantly, it can present variations as desired. In the prior art design, for the sake of the consideration of overloading, the lamp sets are divided into many stages, but this will prevent the bulbs from working synchronously. Therefore, in some. designs, the wire is widened and the output of the controller is increased for resolving the aforesaid problem. However, this will increase cost, and the length of the lamp set will be prolonged. Therefore, if the wire is interrupted, the maintenance work is inconvenient.

A prior art structure is disclosed in U.S. Pat. No. 5,854,541, "a sequential connectable flash lamp set". In that application, a lamp set is formed by a controller and a serial of bulbs. The lamp set has an independent outer power source for being connected to the input end of the controller. A triggering circuit is installed in the controller. The output end of the trigger circuit is connected to the series bulbs. The trigger end thereof is remained empty for being connected with other components so as to capture the outer oscillating signal to conduct and cut off the oscillating circuit. Therefore, the lamp set has a flash effect. Moreover, many lamp sets are connected to prolong the length of the lamp sets. The connected lamp sets may flash synchronously without overheating. However, this structure has defects, that is, only a string of lamps is formed since the lamp sets are connected in series and cannot be connected in parallel. Therefore, the distribution in a large area is inconvenient. Moreover, the action is a way of rectifying through diode. The action is in a positive pulse point or a negative pulse point, the switching for flash way is only one, so that the effect is dull and the beauty in the decorating lamp cannot be present.

SUMMARY OF THE INVENTION

Accordingly, the primary object of the present invention is to provide a synchronous multiple serial-lamps sets comprises a plurality of serial or serial and parallel lamp sets; each lamp set being formed by a plurality of light emitters and insulating leads; an IC set having functions of receiving power, signals, presetting, and emitting control signals; an IC set auxiliary part having functions of adjusting, variation and controlling the strength of electricity and weight; a power supply connector for being connected to the power supply and IC set and the IC set auxiliary part; and a signal transmission line connected to a plurality of IC sets and the IC set auxiliary parts. The leads serves to connect the lamp sets, IC set, IC set auxiliary part, power supply connector so as to be formed as an integral structure; the power supply connector is connected to a power supply for supplying power to IC set and IC set auxiliary part; in operation, multiple functions is generated, and many lamp sets are operated so that the light emitters are illuminated or extinguished; any one IC set transmits a signal to each IC set, so as to start or reset each lamp sets and thus they have the same preset electric functions, and thus an function of synchronous operation in a plurality of lamp sets is formed.

The various objects and advantages of the present invention will be more readily understood from the following detailed description when reading in conjunction with the appended drawing.

DETAILED DESCRIPTION OF THE PREFERRED EMBODIMENTS

Figure 1:
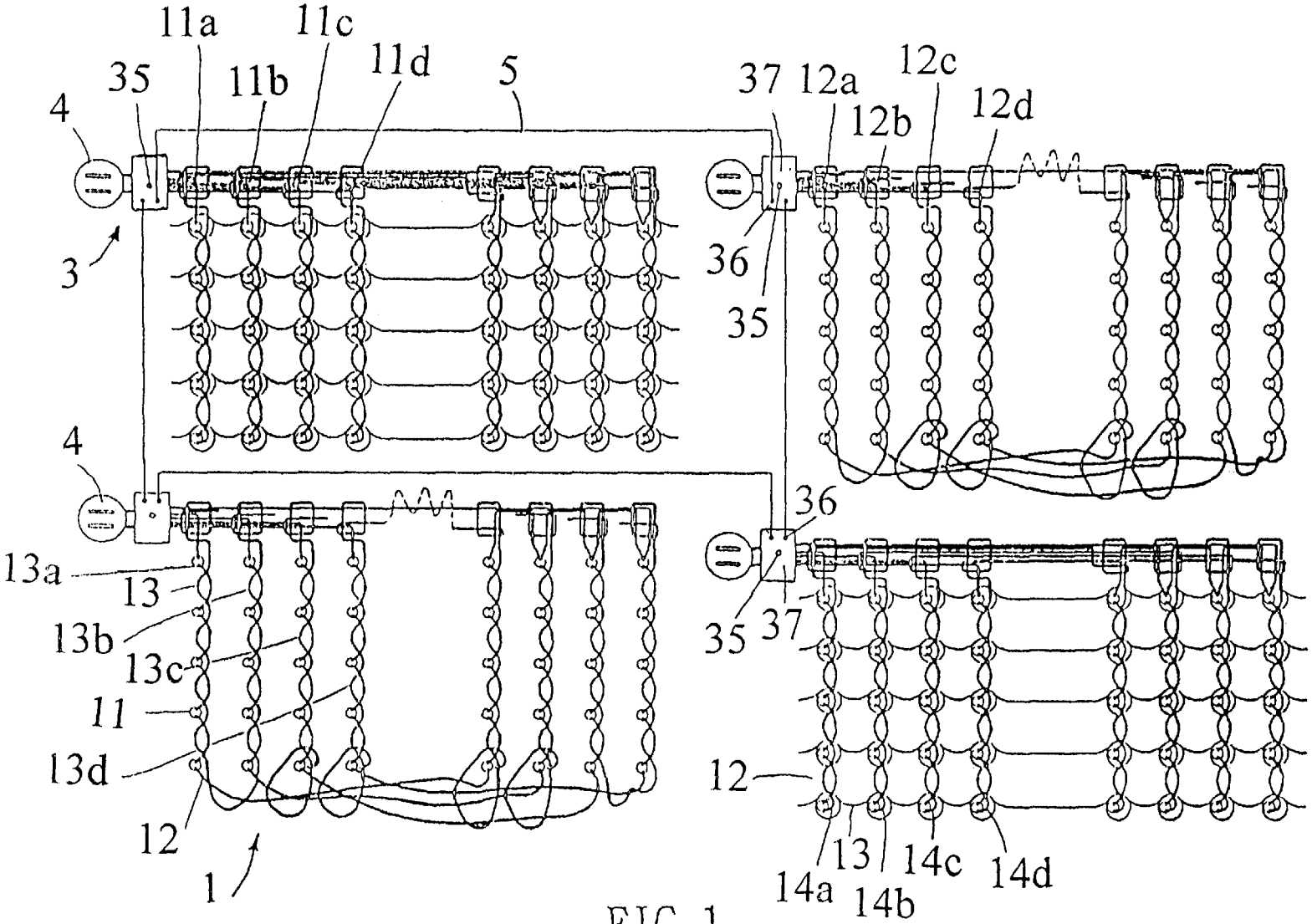
FIG. 1 is a schematic view showing that the present invention is connected in series for prolonging the overall length.
Figure 2:
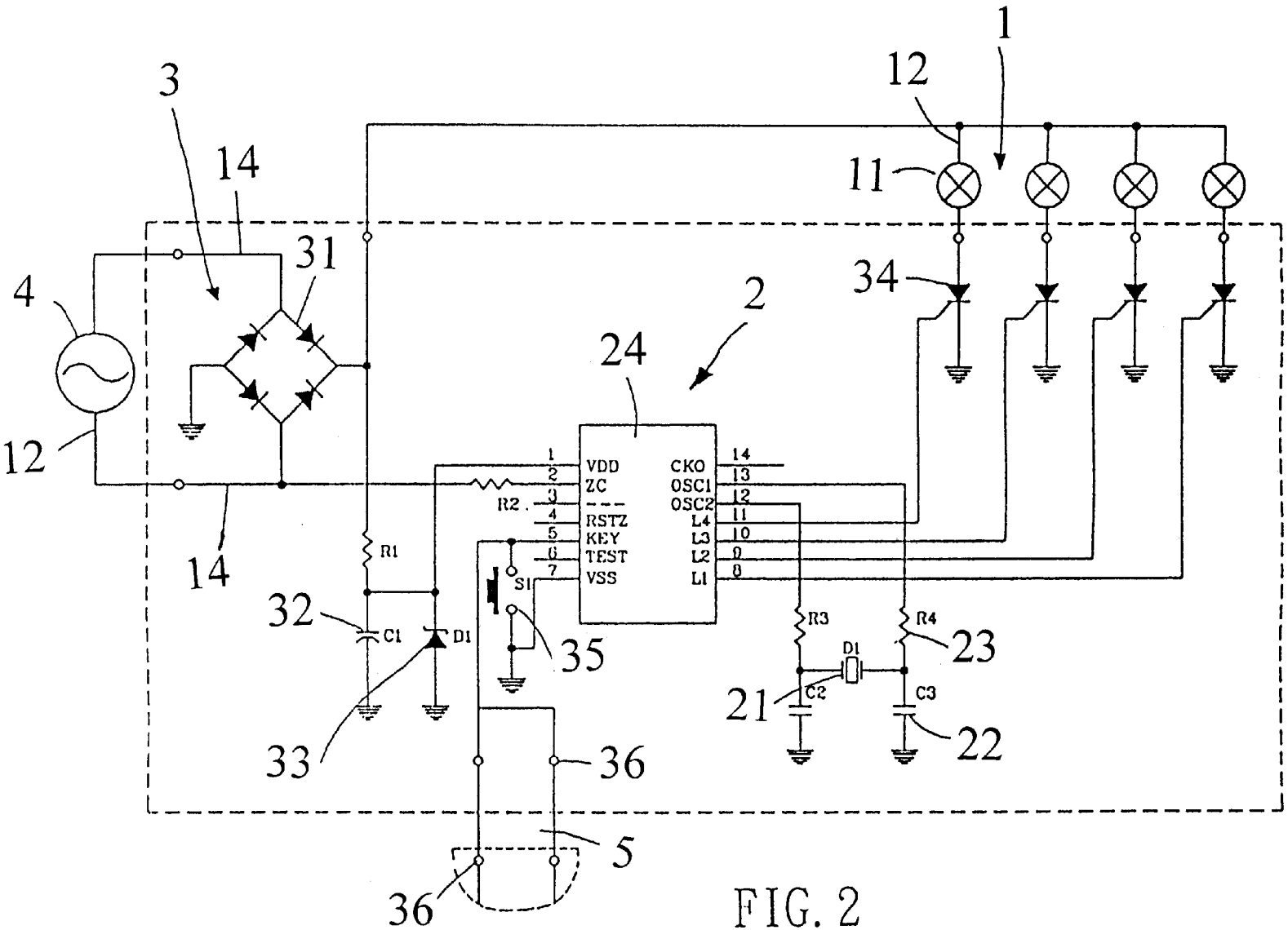
FIG. 2 is a circuit diagram of the present invention.
Figure 3:
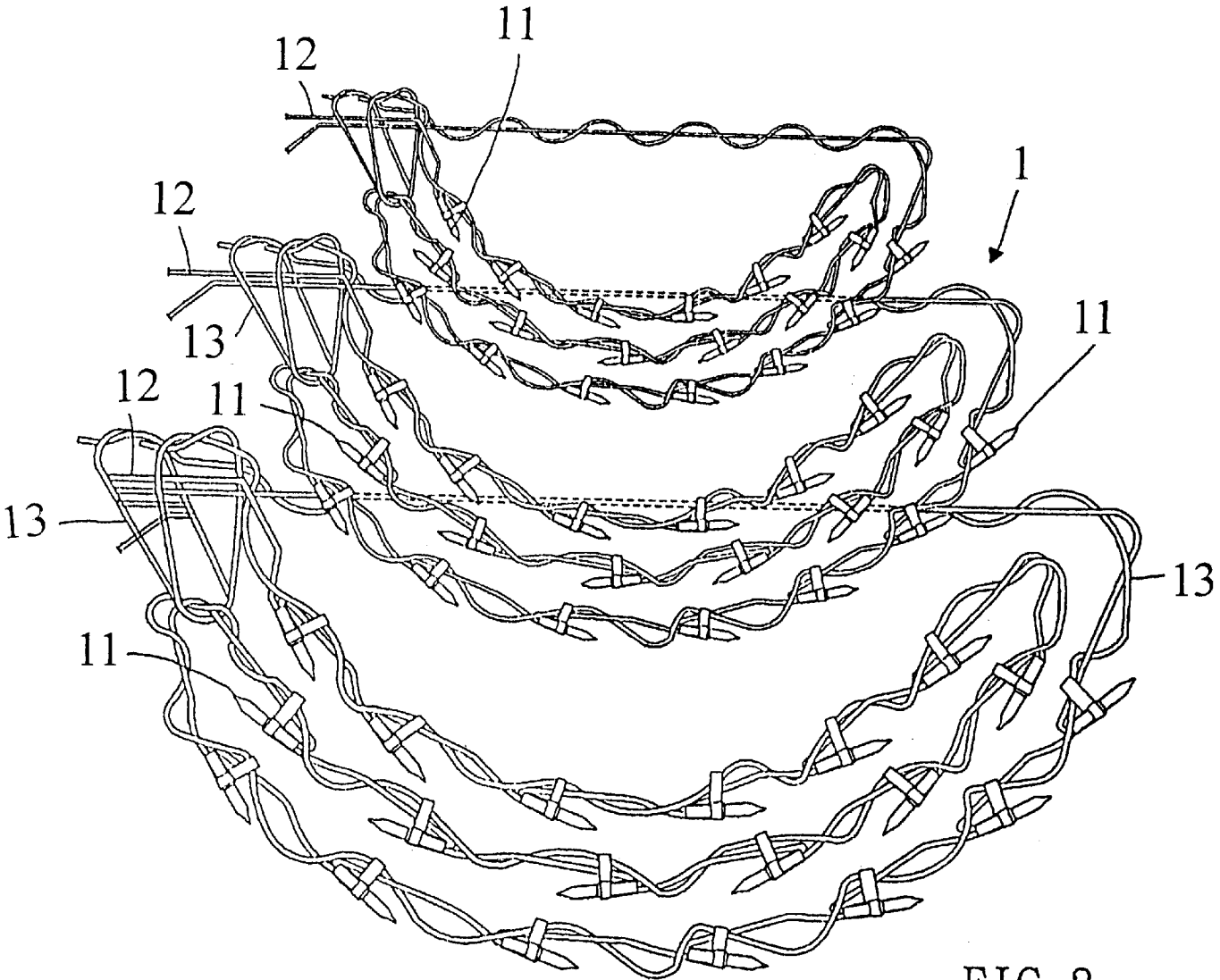
FIG. 3 is a perspective view showing lamp set of the present invention.

With reference to FIGS. 1, 2 and 3, the synchronous multiple serial-lamps sets of the present invention is illustrated. The synchronous multiple serial-lamps sets is primarily formed by a plurality of serial or serial and parallel lamp sets 1. Each lamp set 1 is formed by a plurality of light emitters 11 and insulating leads 12.

An IC set 2 has the function of receiving power, signals, presetting, and emitting control signals.

An IC set auxiliary part has the function of adjusting, variation and controlling the strength of electricity and weight.

A power supply 4 for being connected to the power supply and IC set 2 and the IC set auxiliary part; and A signal transmission line 5 connected to a plurality of IC sets 2 and the IC set auxiliary parts 3, and is connected to the power supply connector 4 and a plurality of lamp sets 1 through insulating leads 12, and is connected to the IC set 2 and IC set auxiliary part 3 through leads 14.

The light emitter 11 is a vacuum bubble, a gas inflation bubble or LED. The light emitter 11 can be added with a lamp head or a lamp seat and may be used with serial lamp sets 1. Each lamp set 1 has light emitter 11 with identical or non-identical numbers. The serial lamp sets 1 can be connected through leads 12 or non-leads 13 so as to be formed as lamp sets 1 having identical or different specification.

The IC set 2 has a preset sync control function, which is formed by a quartz oscillator 21, a capacitor 22 and a resistor 23, and an IC 24 which are formed as an oscillating circuit through a lead 14 so as to generate a basic reference frequency. The actions in the IC 24 can be based on this frequency so as to achieve the function of synchronicity.

The IC set auxiliary part 3 has a rectifier 31, a capacitor 32, a regulating diode 33, SCR 34, a switch 35, a connecting terminal 36, a PC board (not shown) and an insulating casing 37 for adjusting, stabilizing, pushing and actuating the serial lamp set 1. Furthermore, the IC set auxiliary part can be used to connected all parts 3 and protect all the parts 3. The IC set 2 and the IC set auxiliary part 3 are assembled and are installed on the same or different PC board. The PC board must leave a joint for the terminal 36 for being connected to a lead 12. In the preferred embodiment, the insulating casing 37 serves to seal the IC set 2 and the part 3. The lead extends from the insulating casing 37 to connect a power source and lamp set 1 and a switch 35 is placed on the insulating casing 37 for START or RESET. The switch may be a button type or a rotary type. The insulating casing is installed with joints of one or more signal transferring wire 5 and then is connected with the switch 35. The joint on the insulating casing is a female end, and the joint of the signal transferring wire 5 is a male end.

Thereby, as shown in FIGS. 1 and 3, in using, many sets of lamp sets can be serially connected. A power connector 4 is connected to a power source for supplying power to the IC set 2 and the IC set auxiliary part 3. In operation, many electric functions are formed. Powering to the lamp sets 1, the illuminators 11 may light up or extinguish. Further, any IC set 2 transfers signals to each IC set 2 so as to start or reset each lamp set 1 to have the same electric function so that the lamp sets are operated synchronously. For example, the illuminators 11*a,* 12*a,* 13*a,* and 14*a* can operate at the same time. The illuminators 11*b,* 12*b,* 13*b,* and 14*b* are operated at the same time; illuminators 11*c,* 12*c,* 13*c,* and 14*c* are operated at the same time; and the illuminators 11*d,* 12*d,* 13*d,* and 14*d* are operated at the same time; and the illuminators 11*e,* 12*e,* 13*e,* and 14*e* are belonged to the same loop.

In actuating, the synchronous signal generated by the IC sets 2 are low voltage DC current. The signal transferring wire 5 preferably has a diameter larger than that of the insulated lead 12. For example, the insulating lead 12 is #22 AWG wire, then the signal transferring wire is #28 AWG wire. A plurality of signal transferring wire 5 are connected to the joints ends 36 on the insulating casing so as to be connected to each IC set or switches 35 in series or in parallel. Only any one switch 35 is actuated, then a signal can be sent to all lamp set 1.

The IC sets 2 may or may not have the function of memory. But they are connected to a same power source and to each lamp set 1 through the signal transferring wire 5. Meanwhile, after being enabled, the various lamp sets may operate synchronously so that in operation, a plurality of lamp sets 1 are connected to the same power source and they have the same frequency. After passing through rectifier and resistor, the same wave shape frequency is input the IC set 2. Based on the wave shape frequency, a correction is performed intermittently. The differences in the quartz oscillators and IC set auxiliary parts 3 are adjusted so that the flashing of all lamps are consistent.

Figure 4:
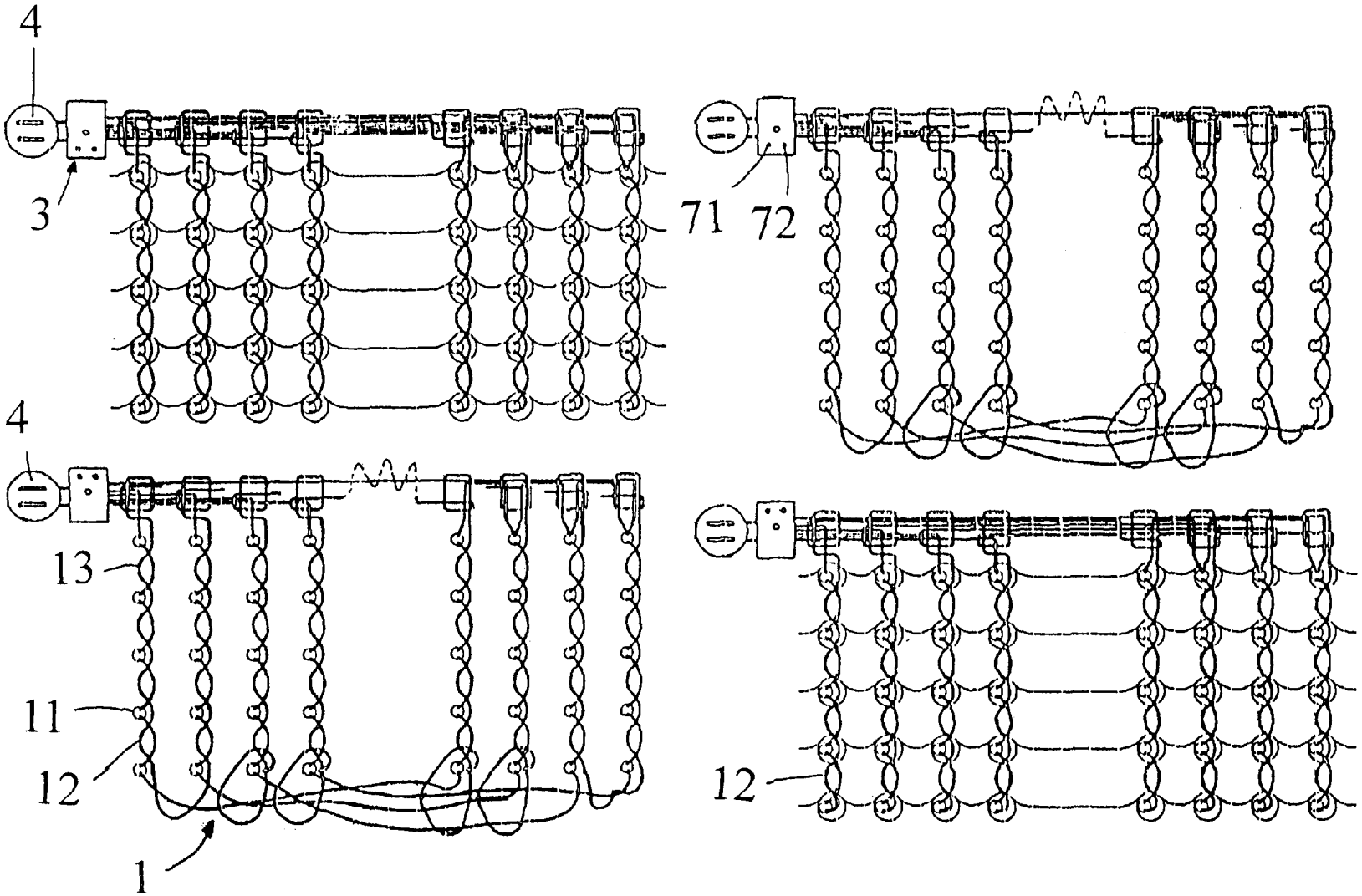
FIG. 4 is a schematic view showing the modification of the present invention in a wireless transmission.
Figure 5:
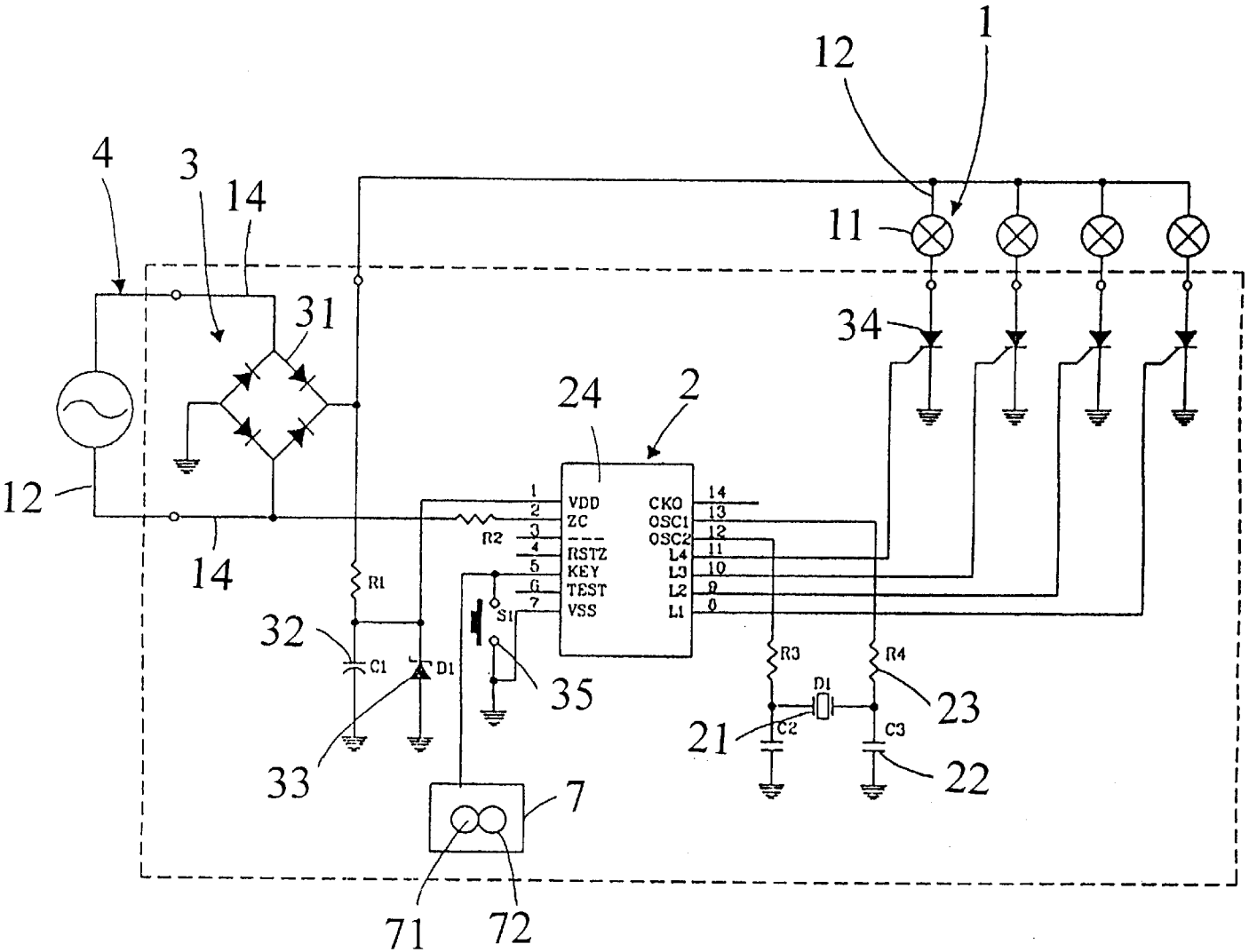
FIG. 5 is a circuit diagram showing the modification of the present invention in a wireless transmission.

With reference to FIGS. 4 and 5, in embodying the present invention, the original wired signal transferring wire 5 is changed as a signal transceiver 7 for being connected to the IC sets 2 and auxiliary parts 3. The wireless signal is infrared ray IR signal or microwave signal RF so that the signal generator 71 and the receiver 72 can be formed in one body. Basic on the consideration of application, the preset switches or restart function of the IC set 2 can be switched or reset automatically, or as the aforesaid embodiment, switches 35 can be installed for switching manually or resetting the lamp sets 1.

Thereby, the IC set 2 emits control signals to the generator 71 and then the signal is emitted outwards to the receiver 72 of each lamp set 1 so as to actuate or restart each lamp set 1 at the same time. Thus the wires for connecting the parts can be reduced effectively so that the distant lamp sets still acts synchronously.

From above description, it is known that the present invention has a simple structure and is practical in application. Each unit has many output for actuating may lamps so as to have various switching and control functions. Therefore, the enabled lamp sets can flash transversally or longitudinally at the same time. Consequently, the present invention has an effect superior than the prior art.

The above described embodiments are not intended to limit the scope of the present invention, as one skilled in the art can, in view of the present invention, expand such embodiments to correspond with the subject matter of the present invention claimed below. Therefore, all such substitutions and modifications are intended to be embraced within the scope of the invention as defined in the appended claims.

What is claimed is:

1. A synchronous multiple lamp set display comprising:

a) a plurality of lamp sets, each lamp set including i) a plurality of light emitters connected by insulating leads so as to form an elongated string of light emitters;

ii) a controller connected to the insulating leads, the controller including an oscillating circuit with a quartz oscillator, an integrated circuit (IC), and a capacitor, a rectifier, a regulating diode connected with the IC so as to control a lighting sequence of the plurality of light emitters; and iii) a power supply connection; and, b) a device connecting each controller with a controller of another of the plurality of lamp sets to control a lighting sequence of the plurality of light emitters.

2. The synchronous multiple lamp set display of claim 1 wherein each of the plurality of lamp sets further include a SCR connected between each light emitter and the IC.

3. The synchronous multiple lamp set display of claim 1 wherein the device connecting the controllers comprises a signal transmission line.

4. The synchronous multiple lamp set display of claim 1 wherein the light emitters comprise a light bulb.

5. The synchronous multiple lamp set display of claim 1 wherein the light emitters comprise LEDs.

6. The synchronous multiple lamp set display of claim 1 wherein the device connecting the controllers comprises a wireless signal transmission/receiving device.

7. The synchronous multiple lamp set display of claim 6 wherein the wireless signal transmission/receiving device comprises an infrared signal transmission/receiving device.

8. The synchronous multiple lamp set display of claim 6 wherein the wireless signal transmission/receiving device comprises a microwave signal transmission/receiving device.

* * * * *